US008334021B2

(12) United States Patent
Hoefler et al.

(10) Patent No.: US 8,334,021 B2
(45) Date of Patent: Dec. 18, 2012

(54) ALDEHYDE REDUCTION IN AQUEOUS COATING AND LEATHER FINISHING COMPOSITIONS

(75) Inventors: Joseph M. Hoefler, Bensalem, PA (US); Kelley L. Klein, Reading, PA (US); Jill A. Ottinger, Roslyn, PA (US)

(73) Assignee: Rohm and Haas Company, Philadelphia, PA (US)

( * ) Notice: Subject to any disclaimer, the term of this patent is extended or adjusted under 35 U.S.C. 154(b) by 508 days.

(21) Appl. No.: 12/228,348

(22) Filed: Aug. 12, 2008

(65) Prior Publication Data

US 2010/0037399 A1 Feb. 18, 2010

(51) Int. Cl.

| | |
|---|---|
| ***B05D 5/00*** | (2006.01) |
| ***B05D 7/12*** | (2006.01) |
| ***B05D 3/02*** | (2006.01) |
| ***C14C 11/00*** | (2006.01) |

(52) U.S. Cl. ..... 427/385.5; 427/384; 8/94.1 R; 8/94.15; 8/115.54; 8/115.64; 8/115.65

(58) Field of Classification Search ..... 8/94.15
See application file for complete search history.

(56) References Cited

U.S. PATENT DOCUMENTS

| | | | | |
|---|---|---|---|---|
| 3,654,221 | A | 4/1972 | Greer | |
| 3,756,992 | A | 9/1973 | Dieterich | |
| 3,969,421 | A | 7/1976 | d'Ostrowick et al. | |
| 4,103,093 | A * | 7/1978 | Lewis et al. | 560/205 |
| 4,490,460 | A * | 12/1984 | Shimba et al. | 430/504 |
| 4,788,001 | A | 11/1988 | Narula | |
| 4,952,623 | A * | 8/1990 | Auchter et al. | 524/517 |
| 5,205,836 | A | 4/1993 | Hansen et al. | |
| 6,541,560 | B1 * | 4/2003 | Rozynov et al. | 524/547 |
| 6,737,444 | B1 * | 5/2004 | Liu | 516/55 |
| 6,849,758 | B1 * | 2/2005 | Muller-Engel et al. | 560/196 |
| 2004/0074009 | A1 | 4/2004 | Kittmer et al. | |
| 2006/0141236 | A1 | 6/2006 | Nakamura et al. | |
| 2007/0138671 | A1 | 6/2007 | Anastasiou et al. | |

FOREIGN PATENT DOCUMENTS

| | | | |
|---|---|---|---|
| CN | 1427045 | A | 7/2003 |
| CN | 1432608 | A | 7/2003 |
| CN | 1657104 | A | 8/2005 |
| DE | 102004001537 | A | 8/2005 |
| EP | 1553 106 | A1 | 7/2005 |
| JP | 2000-354622 | | 12/2000 |
| JP | 2004-290543 | | 10/2004 |
| JP | 2005-137601 | | 6/2005 |
| WO | 2009084237 | A1 | 7/2009 |
| WO | WO 2009/084237 | A1 | 7/2009 |

OTHER PUBLICATIONS

295506 Search in EIC/STN, completed by STIC on Jun. 2, 2009.*
"Guanidine and Derivatives", copyright 2006 Wiley-VCH Verlag GumbH & Co.*

* cited by examiner

*Primary Examiner* — Harold Pyon
*Assistant Examiner* — Katie L Hammer
(74) *Attorney, Agent, or Firm* — Andrew E. C. Merriam

(57) ABSTRACT

The present invention provides methods for reducing the level of free aldehydes in coatings for flexible substrates, such as tanned leather, and substantially aldehyde free substrates. The methods comprise applying to the substrate a composition of one or more aqueous emulsion or suspension composition of an acrylic polymer or silicon containing polymer that is made from, or contains one or more lower alkyl alcohol or degrades on storage or in use to form such an alcohol, and one or more water-insoluble to slightly water soluble aldehyde scavenger compound, followed by drying or curing the applied composition to form a coating. In addition, the methods provide enhanced aldehyde scrubbing, especially for acetaldehyde, by applying to a substrate an aqueous acrylic polymer or silicon containing polymer emulsion or suspension comprising a aldehyde scavenger compound that is substantially deprotonated, i.e. by raising the pH composition to 5.5 or higher. The present invention also provides treated and coated substrates made by the inventive methods.

9 Claims, No Drawings

ALDEHYDE REDUCTION IN AQUEOUS COATING AND LEATHER FINISHING COMPOSITIONS

The present invention relates to methods of reducing the level of aldehydes in coatings for flexible substrates, such as leather, and for substantially aldehyde free substrates, as well as the products made thereby, for example finished leather. More particularly, it relates to methods of applying a coating to a substrate wherein the coating comprises aqueous emulsion or suspension of an acrylic polymer or silicon containing polymer that is made from, contains or degrades on storage or in use to form lower alkyl alcohols, especially ethanol, and a water-insoluble to slightly water soluble aldehyde scavenger compound, such as water-insoluble to slightly water soluble salts of aminoguanidine or semicarbazides, water-insoluble to slightly water soluble dihydrazides, water-insoluble to slightly water soluble azoles and water-insoluble to slightly water soluble azines, and drying to form a coating. Preferably, the aldehyde scavenger compound is aminoguanidine bicarbonate.

Many leather finishing products, as well as the finished leather, contain excessive residual amounts of aldehydes, such as formaldehyde and acetaldehyde. Limits for acetaldehyde have recently been established and specified by manufacturers and resellers of tanned leather and finished leather using various analytical methods to determine VOC content of finished leather. For example, tanneries have been compelled by those buying tanned leather from them to limit aldehyde emissions from finished (coated) and tanned leather, especially for automotive use. In addition, Automotive OEMs and their tier suppliers have recently identified acetaldehyde (AcHO) in leather products and have turned back responsibility for reducing acetaldehyde to their suppliers, i.e. tanneries, makers of retans, makers of coating materials and leather finishers. In leather goods and in coatings, AcHO is an issue separate from formaldehyde (HCHO).

Although it is known that there is an AcHO issue in both tanned and finished leather, the source of the AcHO has remained a mystery despite recent developments.

United States patent publication no. 2004/0074009A, to Kittmer et al., address the formaldehyde issue in the wet end treatment or tanning of leather; however, the problem solved by Kittmer et al. was caused by the aldehyde containing synthetic tanning agents used to treat the leather in Kittmer et al. Such aldehyde containing tanning agents are not found in aqueous acrylic polymer or silicon containing polymer emulsions or suspensions; however, there remains an aldehyde emissions problem with coatings made from those products, and a need to control such emissions from such products.

The present inventors have unexpectedly found aldehydes, including AcHO, in aqueous acrylic polymer or silicon containing polymer emulsion or suspension compositions that are used for finishing leather and for coating other substrates, e.g. synthetic leather, thermoplastics, and substantially aldehyde free substrates, such as natural wood, concrete and gypsum. Accordingly, the present inventors have sought to reduce aldehyde emissions, e.g. AcHO, from goods that are coated and finished with aqueous acrylic polymer or silicon containing polymer emulsions or suspensions.

STATEMENT OF THE INVENTION

According to the present invention, methods for reducing the level of aldehydes in coatings for flexible substrates or for substantially aldehyde free substrates comprise applying to the substrate one or more aqueous emulsion or suspension composition of (i) an acrylic polymer or silicon containing polymer that is made from, contains or degrades on storage or in use to form a lower alkyl alcohol, especially ethanol, and (ii) one or more water-insoluble to slightly water soluble aldehyde scavenger compound aldehyde scavenger compound chosen from a water-insoluble aldehyde scavenger compound, and drying or curing the applied composition to form a coating. Water-insoluble to slightly water soluble aldehyde scavenger compounds are any having a water solubility of 15 g or less per 100 g water @ 30° C. Preferably, the water-insoluble to slightly water soluble aldehyde scavenger compound comprises one or more substantially deprotonated aldehyde scavenger compound.

The aqueous emulsion or suspension may be, for example, a silicon containing polymer antiblocking additive for coatings or a feel additive for leather finishing, or it may be an acrylic polymer emulsion paint or coating for leather, such as tanned leather or finished leather, or for substantially aldehyde free substrates chosen from wood, and substantially aldehyde free building materials, e.g. cementitious substrates. Suitable substantially aldehyde free building material substrates may include, for example, masonry, brick, mortar, concrete, spackling and gypsum board; fiberglass insulation, reinforcing mat for roofing or flooring applications, and roving; reinforcement scrim for cementitious or non-cementitious masonry coatings; ceiling tiles, cellulosic roofing tiles; window treatments, glazing, caulk, sheathing and wall coverings; chipboard and fiberboard.

Suitable aqueous silicon containing polymer emulsions or suspensions may comprise one or more silicon containing polymer, optionally containing silanol (SiOH) or hydrolyzable groups, and one or more nonionic surfactant. Suitable nonionic surfactants may be chosen from alkyl polyalkoxy ethers, alkoxylated fatty alcohols, such as, preferably, a $C_{12}$-$C_{14}$ secondary alcohol ethoxylate, polyalkoxylated glycerides, polyether modified siloxanes, alkoxylated polysiloxanes and alkoxylated organic group treated silicas.

Suitable acrylic emulsion or suspension polymers may comprise the (co)polymerization product of one or more of any $C_1$-$C_6$ alkyl (meth)acrylate, $C_1$-$C_6$ hydroxyalkyl (meth) acrylate, glycolated or ethoxylated (meth)acrylate, (poly) alkoxylated (meth)acrylate, or $C_1$-$C_6$ aminoalkyl (meth)acrylate. Such (meth)acrylate monomers are made by esterification with alcohols; and the polymers produced from such monomers produce or liberate aldehydes on storage, shear and/or heating. Suitable acrylic emulsion (co)polymers can comprise the polymerization product of up to 10 wt. % of hydroxyl, carboxyl, amine, glycolated or alkoxylated acrylic monomers, preferably up to 5 wt. %, or 1 wt. % or less.

Preferably, the water-insoluble to slightly water soluble aldehyde scavenger compound may be chosen from aminoguanidine bicarbonate (AGB), and adipoyl dihydrazide.

Suitable substantially deprotonated water-insoluble to slightly water soluble aldehyde scavenger compound compositions may be chosen from any aminoguanidine, semicarbazide, hydrazine compound and guanamine compound having a pH of 5.5 or higher, preferably 7.5 or higher, or 8.0 or higher, and, preferably, up to 9.5. Volatile bases, such as ammonia, alkyl amines and alkylene diamines or triamines may be used to deprotonate the aldehyde scavenger compounds.

In another embodiment, the present invention provides coated or treated flexible substrates and substantially aldehyde free substrates formed by the methods of the present invention, such as finished leather, wood, painted or sealed concrete, painted or sealed plaster, mud or adobe, painted or sealed sheetrock, and binder treated fiberglass insulation.

All ranges recited are inclusive and combinable. For example, a proportion of 1.3 wt. % or more, for example, 1.5 wt. % or more, which may be 4.5 wt. % or less, or 4.0 wt. % or less, will include ranges of 1.3 wt. % or more to 4.5 wt. % or less, 1.5 wt. % or more to 4.5 wt. % or less, 1.5 wt. % or more to 4.3 wt. % or less, and 1.3 wt. % or more to 4.3 wt. % or less.

Unless otherwise indicated, all pressure units are standard pressure and all temperature units refer to room temperature.

All phrases comprising parenthesis denote either or both of the included parenthetical matter and its absence. For example, the phrase "(co)polymer" includes, in the alternative, polymer, copolymer and mixtures thereof.

As used herein, the term "acrylic polymer" refers to polymers comprising the polymerization product of acrylate and/or methacrylate monomers.

As used herein, the phrase "aqueous" includes water and mixtures comprising water and one or more water-miscible solvent.

As used herein, the phrase "based on the total weight of solids" or "based on total solids" refers to weight amounts in comparison to the weight of the total composition amount of polymer, surfactant, binder and any filler or pigment.

As used herein, unless otherwise indicated, the phrase "(co)polymer" includes, independently, copolymers, terpolymers, block copolymers, segmented copolymers, graft copolymers, and any mixture or combination thereof.

As used herein, the term "Glass transition temperature" or "Tg" means the temperature at or above which a glassy polymer will undergo segmental motion of the polymer chain. Unless otherwise indicated, the glass transition temperatures of a polymer are calculated using the Fox equation, *Bulletin of the American Physical Society* 1, 3 Page 123 (1956).

As used herein, the phrase "heat-resistant fibers" and means fibers which are substantially unaffected by exposure to temperatures of from 125° C. to 400° C. during processing. The phrase "heat resistant non-wovens" means non-wovens made from heat-resistant fibers As used herein, the term "(meth)acrylate" means acrylate, methacrylate, and mixtures thereof and the term "(meth) acrylic" used herein means acrylic, methacrylic, and mixtures thereof.

As used herein, unless otherwise indicated, the phrase "molecular weight" for acrylic polymers refers to the weight average molecular weight of a polymer as measured by gel permeation chromatography (GPC) against a polyacrylic acid standard; for silicon containing polymers, unless otherwise indicated, the phrase "molecular weight" refers to the weight average molecular weight of a polymer as measured by gel permeation chromatography (GPC) against a polystyrene standard.

As used herein, the phrase "(poly)alkoxylated" or "(poly) alkoxylate" refers to a molecule containing one or more oxyethylene or oxypropylene group, a mixture thereof, or a combination thereof, preferably, one or more oxyethylene group.

As used herein, the term "substantially aldehyde free" refers to substrates that are substantially free from added formaldehyde, and which do not liberate substantial formaldehyde as a result of drying and/or curing.

As used herein, the term "substantially deprotonated" refers to aldehyde scavenger compounds in which 10% or more of the amine groups are in a nonionic state.

As used herein, the term "suspension" refers to an mixture containing a solid as a disperse phase or any two phase fluid not comprising an emulsifier or surfactant.

As used herein, the term "water-insoluble" refers to any substance that has a water solubility of less than 0.25 g per 100 g of water at 30° C.

As used herein, the phrase "wt. %" stands for weight percent.

According to the methods of the present invention, coatings and finishes comprising aqueous emulsion or suspension polymers, and the substrates bearing such coatings and finishes, have reduced levels of both acetaldehyde and HCHO. The present inventors have discovered aldehyde emission problems in coatings comprising aqueous acrylic polymers and silicon containing polymers made with, contain or degrade to form lower alkyl alcohols, especially ethanol. Such silicon and acrylic containing polymers produce or liberate aldehydes on storage, shear, aging, exposure to light and/or heating. Accordingly, the present inventors have found that the most effective aldehyde scavenger compounds in such aqueous coating and finishing compositions are aldehyde scavenger compounds that remain in or are compatible with the disperse phase of an aqueous acrylic or silicon containing polymer emulsion or suspension. In addition, the present inventors have found that increasing the pH of such coating and finishing compositions improves the effectiveness of the aldehyde scavenger compounds contained therein.

The methods of the present invention find use in leather finishing, i.e. of tanned leather. Further, the methods of the present invention find use in lowering the level of AcHO and HCHO in the aqueous coating composition itself. Accordingly, the methods of the present invention find use in treating substantially aldehyde free substrates, for example, building materials and ceramics, to maintain very low AcHO and HCHO levels in the coated or treated substrate.

Suitable acrylic emulsion or suspension polymers may comprise the (co)polymerization product of one or more of any $C_1$-$C_6$ alkyl (meth)acrylate, $C_1$-$C_6$ hydroxyalkyl (meth) acrylate, glycolated or ethoxylated (meth)acrylate, (poly) alkoxylated (meth)acrylate, or $C_1$-$C_6$ aminoalkyl (meth)acrylate, preferably, one or more $C_1$-$C_4$ alkyl (meth)acrylate. Preferably, acrylic polymers for use on leather and flexible substrates comprise copolymers of ethyl acrylate or butyl acrylate having a Tg of 10° C. or below. For wood, cements and other substantially aldehyde free building material substrates, acrylic copolymers may comprise copolymers of methyl methacrylate having a Tg of 70° C. or less and 10° C. or more.

Silicon containing emulsion or suspension polymers suitable for use in the present invention may be any such polymers containing silanol groups, alkoxysilane groups, alcohol groups, polyol groups, or (poly)ether groups or any polymers containing glycols, alcohols or alkoxy group containing nonionic surfactants as part of their composition.

Suitable water-insoluble to slightly water soluble aldehyde scavenger compounds may be used as is or it may be reacted with acid in water until they gas off to make a salt that is considered water-insoluble to slightly water soluble. To make salt, add one or more acid, such as $H_2CO_3$, to aqueous mixtures comprising one or more aldehyde scavenger compound and stir for a period of from 2 minutes to 12 hours, preferably, 30 minutes or less.

Suitable water-insoluble to slightly water soluble aldehyde scavenger compounds may be chosen from AGB, semicarbazide bicarbonate, guanamine bicarbonate, hydrazine bicarbonate, aminoguanidine (di)borate, semicarbazide (di)borate, guanamine (di)borate, hydrazine (di)borate, aminoguanidine metaphosphate, semicarbizide metaphosphate, guanamine metaphosphate, hydrazine metaphosphate, aminoguanidine polyphosphate, semicarbizide polyphosphate, guanamine polyphosphate, hydrazine polyphosphate, a dihydrazide of a $C_6$-$C_{18}$ (aryl)alkyl dicarboxylic acid, a fatty acid salt of aminoguanidine, a fatty acid salt of semicarbizide, a fatty acid salt of a hydrazine, a fatty acid salt of a guanamine, a $C_6$-$C_{12}$ carboxylic acid salt of aminoguanidine, a $C_6$-$C_{12}$ carboxylic acid salt of semicarbizide, a $C_6$-$C_{12}$ carboxylic acid salt of a guanamine, a $C_6$-$C_{12}$ carboxylic acid salt of a hydrazine, an aromatic carboxylic acid salt of aminoguanidine, an aromatic carboxylic acid salt of semicarbazide, an aromatic carboxylic acid salt of a hydrazine, an aromatic carboxylic acid salt of a guanamine, an unsaturated carboxylic acid salt of aminoguanidine, an unsaturated carboxylic acid salt of semicarbizide, an unsaturated carboxylic acid salt of a hydrazine, an unsaturated carboxylic acid salt of a guanamine, an unsaturated carboxylic acid substituted hydrazine, a polymer of an unsaturated carboxylic acid substituted hydrazine, a $C_1$-$C_{18}$ alkyl substituted aminoguanidine, a $C_1$-$C_{18}$ alkyl substituted semicarbazide, a $C_1$-$C_{18}$ alkyl substituted hydrazine, a $C_1$-$C_{18}$ alkyl substituted guanamine, a $C_6$-$C_{18}$ (alkyl)aryl substituted aminoguanidine, a $C_6$-$C_{18}$ (alkyl)aryl substituted semicarbazide, a $C_6$-$C_{18}$ (alkyl)aryl substituted hydrazine, and a $C_6$-$C_{18}$ (alkyl)aryl substituted guanamine. Preferably, the alkyl substituted water-insoluble to slightly water soluble aldehyde scavenger compound is chosen from a $C_3$-$C_{18}$ alkyl substituted aminoguanidine, a $C_3$-$C_{18}$ alkyl substituted semicarbazide, a $C_3$-$C_{18}$ alkyl substituted hydrazine, and a $C_3$-$C_{18}$ alkyl substituted guanamine.

Examples of suitable water-insoluble to slightly water soluble aldehyde scavenger compounds may be, for example, AGB, a phenylhydrazine, adipoyl dihydrazide, a polyacrylic acid hydrazide, maleic hydrazide, aryl guanamines, such as benzoguanamine or phenylguanamine, aryl hydrazines, and decanoyl guanamine (capryl guanamine).

Unsaturated acids may also be used to form water-insoluble to slightly water soluble aldehyde scavenger salt compounds, e.g. acryloyl hydrazide or polyacrylic hydrazide.

Suitable acids and fatty acids that can be used to form water-insoluble to slightly water soluble aldehyde scavenger salt compounds may include, for example, $H_2CO_3$, boric acid, alkali metal salts of boric acid; fatty acids, such as, stearic acid, lauric acid, linoleic acid, linolenic acid and oleic acid; carboxylic acids, such as, hexanoic acid, adipic acid, sebacic acid, suberic acid, caprylic acid, capric acid, enanthic acid, undecanoic acid, and dodecanoic acid; aromatic carboxylic acids, such as, isophthalic acid, phthalic acid, cinnamic acid, terephthalic acid, naphthoic acids, benzoic acid, phenylacetic acid, and nicotinic acid; unsaturated carboxylic acids, such as, (meth)acrylic acid, maleic acid, and fumaric acid.

In a preferred embodiment, one or more substantially deprotonated aldehyde scavenger compound is used in coating or finishing compositions at a high pH of 5.5 or higher, and up to 13, preferably, 12 or less. Volatile bases and neutralizing agents, such as amines improve the aldehyde removing performance of the coating or finishing composition. Substantially deprotonated aldehyde scavenger compounds may be any aminoguanide, semicarbazide, hydrazine compound, guanamine, organosubstituted forms of any of these aldehyde scavengers, and any water-insoluble aldehyde scavenger compound wherein 10% or, preferably, 50% or more of the amine groups are in a nonionic state.

Where the aldehyde scavenger compound composition is mixed into a polyurethane dispersion, the pH of the aldehyde scavenger compound should be kept at 9.5 or below to avoid undesired reaction between any amine or aldehyde scavenger compound and the polyurethane. Suitable aldehyde scavenger compounds that can be substantially deprotonated may be, for example, aminoguanidine, 2,4-dihydrazino-6-methylaminotriazine, $C_1$-$C_{12}$alkyl hydrazines, and $C_1$-$C_{12}$ alkyl guanamines and any water-insoluble aldehyde scavenger compound.

Aldehyde scavenger compounds may be used in the amount of 1-100 molar equivalents based on the number of molar equivalents of free aldehyde found in the one or more aqueous silicon containing polymer or acrylic polymer composition, for example, up to 10 molar equivalents, preferably, 3 or more molar equivalents, or, more preferably, up to 8 molar equivalents. Molar equivalents of free aldehyde are measured by headspace sampling the aqueous polymer composition, which may include surfactant and water miscible solvent, in a vial having a volume of 22 ml at 105° C. and a pressure of 0.138 MPa.

Silicon containing polymer or gum (neat polymer) may be any organosiloxane, such as a linear organosiloxane, e.g. a diorganosiloxane, including homopolymers, copolymers, ter- or tetra-polymers. Suitable silicon containing materials for use in the methods of the present invention may be chosen from linear polymers, such as mono- or di-organosiloxanes, optionally, with more than one SiOH terminal group, and branched polymers comprising less than 2 wt. %, based on the total weight of the polymer, of residues derived from polymerization of a silsesquioxane. Preferred silicon containing polymers include linear polydimethylsiloxanes (PDMS).

The molecular weight (MW) of suitable silicon containing polymer should be low enough that one can disperse the polymer in water and yet high enough to insure polymer durability, for example, from 75,000 up to 80 million, or up to 30 million and, preferably, up to 1 million.

Suitable surfactants may be chosen from any one or more alcohol or ether containing surfactant, such as a nonionic surfactant or an anionic surfactant mixed with a nonionic surfactant. Preferred surfactants may comprise alkyl polyalkoxy ethers, polyalkoxylated glycerides, polyether modified siloxanes, polyalkoxylated organo-modified silicas, glycolated organomodified silicas, and fatty alcohol polyalkoxylates. More preferred are mixtures of one nonionic surfactant with a low Hydrophile-Lipophile Balance (HLB) with a nonionic surfactant having a high HLB, such that the two nonionic surfactants have a combined HLB of 11-15, preferably 12.5-14.5. Examples of suitable nonionic surfactants may include, for example, alpha-iso-tridecyl-omega-hydroxy polyglycolether, siloxane polyoxyalkylene copolymers, the condensates of ethylene oxide with long chain fatty alcohols or fatty acids, such as a $C_{12-16}$ alcohol, the condensates of ethylene oxide with an amine or an amide, the condensation products of ethylene and propylene oxide, alkoxylated fatty glycerol esters, alkoxylated ethers or esters of sucrose or sorbitol, and fatty acid alkylol amides.

Some commercially available nonionic surfactants most suitable for use in the present invention include the ethoxylated alcohols sold under the trademark TERGITOL® by The Dow Chemical Company, Midland, Mich. Some example include TERGITOL® TMN-6 which is an ethoxylated alcohol also known as ethoxylated trimethylnonanol, and TERGITOL® 15S15 which is an ethoxylated alcohol also known as $C_{12}$-$C_{14}$ secondary alcohol ethoxylate.

Suitable anionic organic surfactants which can be used include, for example, alkali metal soaps of higher fatty acids, sulphonated ethoxylated alcohols, and sulphosuccinates.

The one or more surfactant may be used in the amount of 0.2-30 wt. %, based on the total weight of surfactant plus silicon containing material, preferably 1 to 15 wt. %, or, more preferably, 2 to 8 wt. %.

The aqueous medium is the continuous liquid phase of an aqueous emulsion or suspension. The aqueous medium contains water and optionally, one or more water miscible solvents. Suitable water miscible solvents include methanol, ethanol, propanol, acetone, ethylene glycol ethyl ethers, propylene glycol propyl ethers, and diacetone alcohol. Preferably, the aqueous medium contains greater than 90 weight % water, and more preferably, greater than 95 weight % water, and most preferably, greater than 98 weight % water, based on the weight of the aqueous medium. The aqueous medium containing from 98 to 100 weight % Water, based on the weight of the aqueous medium, is referred to herein as "substantially free of solvent".

Because the surfactants and/or water miscible solvents may themselves contain; liberate or degrade into free aldehydes, the number of molar equivalents of free aldehyde in any aqueous polymer composition will include the amount of aldehydes present due to the surfactant and/or water miscible solvent.

In embodiments comprising one or more substantially deprotonated aldehyde scavenger compound, suitable aqueous emulsion or suspensions comprising acrylic polymer or silicon containing polymer and substantially deprotonated aldehyde scavenger compound may have a pH of 6 and greater, preferably, 7 and greater, and more preferably, 8 and greater. A suitable upper limit to the pH is 13, preferably 12, and more preferably, 11. A base or an amine may be added in addition to any neutralizing agent used to deprotonate an aldehyde scavenger compound to adjust the pH of the aqueous medium to a suitable range.

Compositions may further include other components, including without limitation, binder polymers, surfactants, pigments, e.g. aqueous silica dispersions, extenders, flatting agents, e.g. acrylic copolymeric duller beads or silica, dyes, pearlescents, adhesion promoters, crosslinkers, other dispersants, defoamers, dispersants, such as anionic polymeric dispersing agents, wetting agents, optical brighteners, ultraviolet stabilizers, coalescents, rheology modifiers, preservatives, biocides, and antioxidants.

The aqueous emulsion compositions may be made by simple mixing, in any order, aldehyde scavenger compound as a powder, aqueous suspension or aqueous dispersion with one or more acrylic polymer or silicon containing polymer. The thus formed compositions can then be mixed with other aqueous polymers to form coating or finishing compositions. To effectively remove aldehydes, including AcHO, the one or more aldehyde scavenger compound is mixed and sheared, shaken or stirred with the silicon containing polymer or acrylic polymer emulsion or suspension for a period of from 0.5 to 120 minutes, preferably, 1 minutes or more and the mixture is allowed to equilibrate for from 1 to 36 hours. The mixing and equilibration can be carried out at room temperature, or up to 100° C., or up to 60° C. The aqueous compositions for use in the application method are storage stable and can be applied to any substrate either "as is" or in combination or admixture with one or more other ingredients, such as binder polymers.

In one embodiment, the present invention provides a silicone polymer auxiliary aqueous suspension composition for leather finishing comprising one or more aldehyde scavenger compound, silicon containing polymer, such as a neat organosiloxane, surfactant, aldehyde scavenger compound and water. In aqueous polyurethane dispersions comprising silicon containing polymer, the silicon containing polymer may be used in a partially or completely neutralized form, such that the polyurethane dispersion has a pH of from 3 to 10, for example, pH 7.5. The silicon containing polymer is preferably alkaline, pH of 7.4 or higher, for compatibility with a topcoat acrylic emulsion or dispersion. The composition may further comprise any one or more of a defoamer, preservative, peroxide, or microbiocide.

In acrylic emulsions or dispersions or polyurethane dispersions for leather finishing or for coating substantially aldehyde free substrates, suitable amounts of silicone polymer auxiliary aqueous suspension ranges from 0.5 to 30 wt. %, based on the total weight of polymer in the composition, or, preferably, 2 wt. % or more, or, preferably, up to 20 wt. %, or, more preferably, up to 10 wt. %.

In another embodiment, the methods of the present invention comprise applying finishing compositions to leather, wherein the aqueous composition comprises from 5 to 30 weight % acrylic polymer particles, based on the weight of the aqueous emulsion or suspension. Preferably, the aqueous acrylic composition contains from 2 to 20 weight % polymer particles and more preferably from 4 to 16 weight % polymer particles, based on the weight of the composition. Such compositions may be used as basecoats and leveling compositions for leather and synthetic leather.

In yet another embodiment, the methods of the present invention comprise applying finishing compositions to building materials, wherein the aqueous composition comprises from 20 to 70 weight % acrylic polymer particles, based on the weight of the aqueous emulsion or suspension. Preferably, the aqueous acrylic composition contains from 30 to 65 weight % polymer particles, based on the weight of the composition.

In methods of coating substantially aldehyde free substrates, suitable substrates the acrylic polymer emulsions may include building products, such as cementitious substrates, e.g. gypsum board, concrete, mortar, adobe, mud, plaster or spackling; heat resistant fibers and heat resistant non-wovens, such as fiberglass insulation and polyester roof tiles; ceramics, such as tile; wood; and flexible plastics, such as synthetic leather.

In tanned leather finishing applications, the aqueous silicon containing polymer emulsion suspension compositions of the present invention to the leather improves feel and anti-abrasion or slip properties of the finished leather. The aqueous acrylic polymer compositions provide soft, low tack basecoats and can act as levelling agents in topcoats. As used herein, the term "Tanned leather" refers to an animal hide or skin that has been preserved by treatment with a tanning agent, such as a salt of chrome, aluminum, zirconium, titanium, iron, or magnesium; or a suitable vegetable extract. An aqueous finishing dispersion may be applied onto the tanned leather by various methods such as spraying, roll coating, and hand swabbing. After contacting the aqueous silica dispersion with the leather, the treated leather is dried or allowed to dry.

The silicon containing polymer compositions are also useful in synthetic leather and in coatings for substantially aldehyde free substrates as an antiblocking agent.

EXAMPLES

In the examples that follow, the following procedure was used:

Aldehyde Content: The aldehyde content of each composition in the Examples (sample) was determined with a gas chromatograph and mass spectrometer (GC/MS) by measuring using the amount of the indicated aldehyde that was evolved in a Tekmar 7050 Carrousel Headspace (Teledyne Technologies Incorporated, Mason, Ohio) static headspace sampler, with polar option. The volume of each headspace vial used to hold each sample was 22 ml and the thermostat temperature in each vial was maintained at 105° C. In each Example, both water and formaldehyde were allowed to fully evaporate within the volume of the headspace vial and then each vial was equilibrated for the indicated time period at the indicated test temperature and pressure. In the end, an aliquot of the headspace gas is transferred via a heated transfer line into a gas chromatograph equipped with a mass selective detector (MSD).

In Examples 1-30, water blanks were included in between polymer samples and polymer samples were analyzed in duplicate; the reported aldehyde content in each Example is the average of the duplicate samples measured.

In the experimental controls in Examples 1-6, 7, 19, 20, 22 and 28 containing no aldehyde scavenger compound, each headspace vial contained a sample of about one drop of an aqueous suspension or emulsion containing from 5 to 15 mg (±0.1 mg), of the polymer listed in each Example. In each Example 1-6, 8-18, 21, 23-27 and 29-30 containing aldehyde scavenger compound, each headspace vial contained about 1 drop of an aqueous suspension or emulsion of from 5 to 15 mg (±0.1 mg), of the polymer mixed with a powder aldehyde scavenger compound that had been allowed to sit for a period of at least 24 hours, or the time period indicated. A drop of sample was added to each headspace vial, which was sealed with a Teflon lined septum and cap.

Before determining aldehyde content, each headspace vial was air pressurized to a standard of 0.138 MPa (20 p.s.i.) for at least 1 minute, and was allowed to equilibrate for 10 minutes at 105° C. The gas in each headspace vial was then injected via heated transfer line into the gas chromatograph.

To convert aldehyde content in grams, as determined via GC/MS testing, to molar equivalents, the amount of aldehyde in each polymer sample was divided by the formula weight (FW) of the aldehyde and multiplied by the number of aldehyde equivalents per mole of each aldehyde tested. For example, 20 ppm of acetaldehyde (AcHO) equals 0.000020 g AcHO in a 1 g sample, divided by FW AcHO (40 g/mol), or 0.0000005 mol or $5\times10^{-7}$ mol AcHO in a 1 g sample. AcHO has 1 equivalent per molecule.

Examples 1-6

Effect of Aldehyde Scavenger Compound on Various Aqueous Silicon Containing Polymers In Examples 1-6 shown in Table 1, below, the duplicates of each sample were prepared from a master batch of the respective silicon containing polymer in which the pH was raised to 9.5 using 2-amino-2-methyl-1-propanol. Five molar equivalents of each aldehyde scavenger compound, based on the amount of free aldehyde determined to be present in the polymer, were added to 300 g aliquots of the appropriate silicone under mixing. This mixing was continued for five minutes after the addition of the aldehyde scavenger compound.

TABLE 1

Aldehyde Reduction Compositions

| Example | Dry Sample Analyte (amount) | Aldehyde Scavenger Compound |
|---|---|---|
| 1 | PDMS with emulsifier[1] | none<br>solid AGB<br>AGB/HCl<br>AGHCl |

TABLE 1-continued

Aldehyde Reduction Compositions

| Example | Dry Sample Analyte (amount) | Aldehyde Scavenger Compound |
|---|---|---|
| 2 | PDMS with emulsifier[1], with an excess of polyether siloxane | none<br>solid AGB<br>AGB/HCl<br>AGHCl |
| 3 | PDMS with dispersant[2] | none<br>solid AGB<br>AGB/HCl<br>AGHCl |
| 4 | PDMS with emulsifier[1] @ pH 9.5 | none<br>solid AGB<br>AGB/HCl<br>AGHCl |
| 5 | PDMS with emulsifier[1], with an excess of polyether siloxane, @ pH 9.5 | none<br>solid AGB<br>AGB/HCl<br>AGHCl |
| 6 | PDMS with dispersant[2] @ pH 9.5 | none<br>solid AGB<br>AGB/HCl<br>AGHCl |

[1]An aqueous emulsion of ~65 wt. %, based on the weight of the composition, of a polydimethyl siloxane having functional groups, and 1.0-5.0 wt. %, based on the weight of the dispersion, of an alpha-iso-tridecyl-omega-hydroxy polyglycolether surfactant; and,
[2]A mixture of water with 14-18 wt. %, based on the weight of the composition, of ethoxylated alcohols and 42-46 wt. %, based on the weight of the composition, of a combination of 60 wt. % of hydroxy terminated PDMS, 15-40 wt. % of secondary alcohol ethoxylates and 7-13 wt. % of glycol modified trimethylated silica with sufficient a glycol-modified trimethylated silica emulsifier to insure that the sample contains 100 ppm of total AcHO + HCHO.

As shown in Table 2, below, samples were allowed to rest overnight before 100 g of each was subjected to heat aging at 60° C. (140° F.) for 10 days. Samples were also submitted at this point for aldehyde determination analysis (105° C. for 10 min).

TABLE 2

Example 1-6 Results

| Example | Aldehyde Scavenger Compound | ppm HCHO | ppm ACHO | pH |
|---|---|---|---|---|
| 1 | none | 7.7 | 0 | 7.28 |
| | solid AGB | 0 | 0 | 7.32 |
| | AGB/HCl | 0 | 0 | 7 |
| | AGHCl | 0 | 0 | 7.06 |
| 2 | none | 15.9 | 85.7 | 6.44 |
| | solid AGB | 0 | 11.1 | 7.39 |
| | AGB/HCl | 0 | 22.8 | 5.66 |
| | AGHCl | 0 | 24.9 | 6 |
| 3 | none | 34.9 | 54.2 | 3.13 |
| | solid AGB | 0 | 7.8 | 4.6 |
| | AGB/HCl | 0 | 19.8 | 2.82 |
| | AGHCl | 4.1 | 18 | 0.84 |
| 4 | none | 3.9 | 0 | 9.51 |
| pH @ 9.5 | solid AGB | 1.7 | 0 | 9.19 |
| | AGB/HCl | 1.2 | 0 | 9.43 |
| | AGHCl | 0 | 0 | 9.46 |
| 5 | none | 4 | 34.9 | 9.33 |
| pH @ 9.5 | solid AGB | 0 | 8.4 | 9.1 |
| | AGB/HCl | 0 | 17.9 | 9.09 |
| | AGHCl | 0 | 13.8 | 9.18 |
| 6 | none | 0 | 56.6 | 9.45 |
| pH @ 9.5 | solid AGB | 0 | 48.4 | 9.46 |
| | AGB/HCl | 10.1 | 21.3 | 9.41 |
| | AGHCl | 5 | 16.2 | 9.34 |

In Examples 1-6, as shown in Table 2, above, the added amount of aldehyde scavenger compound shown in Table 2, above, was sufficient to remove the experimentally determined formaldehyde and acetaldehyde content for the indicated silicon containing polymer. Solid AGB, which is water-insoluble, is more efficient at reducing aldehydes than aminoguanidine hydrochloride, which is water-soluble.

Examples 7-13

The Effect of Water Solubility on Aldehyde Removal

In the following Examples 7-13, a composition comprising the PDMS+emulsifier used in Example 2, above, with an excess of polyether siloxane (PES) was treated with the aldehyde scavenger compound indicated and in the amount shown in Table 3, below:

TABLE 3

| Results | | | | | |
|---|---|---|---|---|---|
| Example | Aldehyde Scavenger Compound | Molar Ratio (Aldehyde Scavenger Compound:CHO) | ppm HCHO | ppm ACHO | pH |
| 7 | Control | 0:1 | 48.5 | 65.4 | 6.19 |
| 8 | ADH | 1:1 | 0 | 51.6 | 6.43 |
| 9 | ADH | 7.35:1 | 0 | 25.8 | 6.35 |
| 10 | ADH | 73.5:1 | 0 | 21.4 | 6.53 |
| 11 | AGHCl | 1:1 | 12.7 | 72.8 | 6.15 |
| 12 | AGHCl | 7.35:1 | 0 | 20.8 | 5.77 |
| 13 | AGHCl | 36.8:1 | 0 | 18.8 | 5.5 |

"ADH" = adipic acid dihydrazide;
"AGHCl" = aminoguanidine hydrochloride

As shown in Table 3 above, adipic acid dihydrazide removes aldehydes more efficiently than the water-miscible or water-soluble salt amino guanidine hydrochloride.

Examples 14-19

The Effect of a Lower pH on Aldehyde Removal

As shown in Table 4, below, the following examples the PDMS+emulsifier composition of Example 1 was treated with Aminoguanidine (AG), a water dispersible aldehyde scavenger compound, and the pH of the polymer composition was lower than the pH of the polymer in Examples 1 and 4 to show how deprotonation impacts the effectiveness of AG as an aldehyde scavenger compound.

TABLE 4

| Example | Mol Ratio (AGHCl:CHO) | ppm HCHO | ppm ACHO | Initial pH |
|---|---|---|---|---|
| 14 | 1:1 | 8.3 | 9 | 6.19 |
| 15 | 2:1 | 1.5 | 6.5 | 6.14 |
| 16 | 3:1 | 1.1 | 3.8 | 6.11 |
| 17 | 5:1 | 0 | 2.8 | 6.07 |
| 18 | 7.5:1 | 0 | 7.2 | 6.02 |
| 19 control | 0:1 | 27.2 | 6.9 | 6.38 |

As shown in shown in Table 4, above, the hydrochloric acid salt of amino guanidine bicarbonate, a water soluble salt, is effective at removing formaldehyde at 2 molar equivalents. More AGHCl is needed, at least 3 or more molar equivalents, to scrub acetaldehyde. At 5 molar equivalents, the performance of AGHCl in Example 17 was not as good as the performance at higher pH (Examples 1 and 4).

Examples 20-21

AGB and its Effect on AcHO Removal

In the following Examples 20-21, as shown in Table 5, below. As shown in Table 5, below, AGB is effective at removing AcHO from a silicon containing polymer suspension.

TABLE 5

| Example | Description | HCHO ppm w/w | AcHO ppm w/w | pH |
|---|---|---|---|---|
| 20 control | PDMS + emulsifier[1] | 30 | 15 | 6.4 |
| 21 | PDMS + emulsifier[1] and 10 mol eq AGB | 0 | 0 | 7.5 |

[1]An aqueous emulsion of ~65 wt. %, based on the weight of the composition, of a polydimethyl siloxane having functional groups, and 1.0-5.0 wt. %, based on the weight of the dispersion, of an alpha-iso-tridecyl-omega-hydroxy polyglycolether surfactant.

Examples 22-27

Effect of pH of AcHO Removal by AGB

The following Examples shown in Table 6, below, are based on PDMS plus dispersant composition of Example 2, above. Control #2 in Example 25 has added amine to increase the pH of that composition.

TABLE 6

| Example | Molar Equivalents Aldehyde Scavenger Compound | HCHO ppm w/w | AcHO ppm w/w | pH |
|---|---|---|---|---|
| 22 | control #1 | 43.4 | 58.3 | 2.9 |
| 23 | w/20 AGB | 5.0 | 6.3 | 6.6 |
| 24 | w/35 AGB | 4.0 | 3.8 | 6.7 |
| 25 | control #2 | 3.9 | 11.8 | 5.6 |
| 26 | w/20 AGB | 1.0 | 0.0 | 8.3 |
| 27 | w/35 AGB | 0.8 | 0.0 | 8.4 |

Amino guanidine bicarbonate (AGB) produces $CO_2$ under acidic conditions. Adding AGB to the polymer sample increases the pH of the sample. In addition, as shown in Examples 22 and 25, raising the pH of the control appears to lower the free aldehyde content in the polymer. Nevertheless, as shown in Examples 26-27, AGB reduces both formaldehyde and acetaldehyde more effectively as a more deprotonated aldehyde scavenger compound than it does as a less deprotonated aldehyde scavenger compound in Examples 23-24. Thus, raising the pH of the polymer composition comprising the water-insoluble to slightly water soluble aldehyde scavenger compound will increase the effectiveness of the aldehyde scavenger compound.

Examples 28-30

Effect of Concentration on HCHO and AcHO Removal by AGB

The following Examples shown in Table 7, below, are based on PDMS plus dispersant composition of Example 2, above.

TABLE 7

| Example | Molar Equivalents Aldehyde Scavenger Compound | HCHO ppm w/w | AcHO ppm w/w |
|---|---|---|---|
| 28 | control | 7.6 | 12.1 |
| 29 | 5 AGB | 0.3 | 0.8 |
| 30 | 50 AGB | 0.1 | 0.7 |

The effectiveness of AGB is concentration dependent. The effectiveness of AGB is also pH dependent. As shown in Examples 26 and 27, in Table 6, above, AGB at a higher concentration in Example 30 in less effective as a scrubber for aldehydes than AGB appears to be for AcHO and HCHO at a lower concentration and at a higher pH.

We claim:

1. A method for reducing the level of residual aldehydes in coatings formed on flexible substrates or on substantially aldehyde free substrates comprising applying to the substrate one or more aqueous emulsion or suspension composition of (i) an acrylic polymer or silicon containing polymer that is made from, contains or degrades on storage or in use to form a lower alkyl alcohol, and (ii) one or more water-insoluble to slightly water soluble aldehyde scavenger compound in the amount of from 1 to 10 molar equivalents based on the number of molar equivalents of free aldehyde found in the polymer, the compound chosen from aminoguanidine bicarbonate (AGB), guanamine bicarbonate, aminoguanidine (di)borate, guanamine (di)borate, aminoguanidine metaphosphate, guanamine metaphosphate, aminoguanidine polyphosphate, guanamine polyphosphate, a dihydrazide of a $C_6$-$C_{18}$ (aryl) alkyl dicarboxylic acid, a fatty acid salt of aminoguanidine, a fatty acid salt of a guanamine, a $C_6$-$C_{12}$ carboxylic acid salt of aminoguanidine, a $C_6$-$C_{12}$ carboxylic acid salt of a guanamine, an aromatic carboxylic acid salt of aminoguanidine, an aromatic carboxylic acid salt of a guanamine, an unsaturated carboxylic acid salt of aminoguanidine, an unsaturated carboxylic acid salt of a guanamine, a $C_1$-$C_{18}$ alkyl substituted aminoguanidine, a $C_1$-$C_{18}$ alkyl substituted guanamine, a $C_6$-$C_{18}$ (alkyl)aryl substituted aminoguanidine, and a $C_6$-$C_{18}$ (alkyl)aryl substituted guanamine, wherein the aqueous composition has a pH of 6 or greater, and drying the applied composition to form a coating on the substrate, whereby aldehyde emissions from thus formed coating or the resulting coated substrate are reduced.

2. The method as claimed in claim 1, wherein the silicon containing polymer comprises one or more silanol or alkoxysilane group, a silicon containing polymer composition containing nonionic surfactants, or one or more acrylic polymer that is the (co)polymerization product of any one or more $C_1$-$C_6$ alkyl (meth)acrylate, $C_1$-$C_6$ hydroxyalkyl (meth)acrylate, $C_1$-$C_6$ aminoalkyl (meth)acrylate, glycolated or ethoxylated (meth)acrylate, or (poly)alkoxylated (meth)acrylate.

3. The method as claimed in claim 1, wherein the one or more aqueous emulsion or suspension comprises one or more silicon containing polymer, and one or more nonionic surfactant.

4. The method as claimed in claim 3, wherein the nonionic surfactant is chosen from alkyl polyalkoxy ethers, alkoxylated fatty alcohols, polyalkoxylated glycerides, polyether modified siloxanes, alkoxylated polysiloxanes and alkoxylated organic group treated silicas.

5. The method as claimed in claim 4, wherein the nonionic surfactant is a $C_{12}$-$C_{14}$ secondary alcohol ethoxylate.

6. The method as claimed in claim 1, wherein the water-insoluble to slightly water soluble aldehyde scavenger compound is chosen from aminoguanidine bicarbonate (AGB), and adipoyl dihydrazide.

7. The method as claimed in claim 1, wherein the aqueous emulsion or suspension composition is substantially free of solvent.

8. The method as claimed in claim 1, wherein the substrate is tanned leather, finished leather, or a substantially aldehyde free substrate chosen from wood, cementitious substrates, ceramics, heat resistant fibers, heat resistant nonwovens, and flexible plastics.

9. A coated or treated substrate formed by the method as claimed in claim 1.

* * * * *